US010257631B2

(12) United States Patent
Li et al.

(10) Patent No.: US 10,257,631 B2
(45) Date of Patent: Apr. 9, 2019

(54) NOTIFYING A USER TO IMPROVE VOICE QUALITY

(71) Applicant: Lenovo (Singapore) Pte. Ltd., Singapore (SG)

(72) Inventors: Scott Wentao Li, Cary, NC (US); Russell Speight VanBlon, Raleigh, NC (US); Robert James Kapinos, Durham, NC (US); Joaquin F. Luna, Durham, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 21 days.

(21) Appl. No.: 14/757,762

(22) Filed: Dec. 23, 2015

(65) Prior Publication Data

US 2017/0188167 A1 Jun. 29, 2017

(51) Int. Cl.

| | |
|---|---|
| ***H04R 29/00*** | (2006.01) |
| *H04R 3/00* | (2006.01) |
| *H04R 3/04* | (2006.01) |

(52) U.S. Cl.

CPC ..... *H04R 29/004* (2013.01); *H04R 3/00* (2013.01); *H04R 3/04* (2013.01); *H04R 29/00* (2013.01); *H04R 2203/00* (2013.01)

(58) Field of Classification Search

CPC ..... H04R 29/004; H04R 3/00; H04R 29/00; H04R 2203/00

See application file for complete search history.

(56) References Cited

U.S. PATENT DOCUMENTS

| | | | | |
|---|---|---|---|---|
| 2005/0113037 | A1* | 5/2005 | Ponce De Leon ..... | H01Q 1/243 455/90.3 |
| 2008/0132283 | A1* | 6/2008 | Ponce De Leon ... | H04B 1/3838 455/566 |
| 2009/0196429 | A1* | 8/2009 | Ramakrishnan ..... | H04R 3/005 381/26 |
| 2011/0237306 | A1* | 9/2011 | Kamii ..... | H04M 1/72519 455/566 |
| 2015/0172446 | A1* | 6/2015 | Aurongzeb ..... | H04W 88/02 455/418 |
| 2015/0304786 | A1* | 10/2015 | Partio ..... | H04R 25/305 381/58 |
| 2016/0050488 | A1* | 2/2016 | Matheja ..... | H04R 3/005 381/56 |

* cited by examiner

*Primary Examiner* — Andrew L Sniezek

(74) *Attorney, Agent, or Firm* — Ference & Associates LLC

(57) ABSTRACT

One embodiment provides a method including: receiving, using a microphone of an electronic device, user audio input; detecting, using a processor, at least one factor that impacts quality of the audio input received; and notifying, using an output device of the electronic device, a user of an event associated with the at least one factor. Other aspects are described and claimed.

16 Claims, 3 Drawing Sheets

NOTIFYING A USER TO IMPROVE VOICE QUALITY

BACKGROUND

Information handling devices (e.g., smart phones, tablets, etc.) may receive audio input from a user and use that input for a variety of purposes. For example, for telephone conversations, users can speak into a microphone located on the device in order to communicate with a person on the other end of the line. As another example, a user can provide audio input into the device in order to direct a virtual personal assistant to perform a specific task.

While providing audio input into a device, the quality of the audio input may be diminished. One reason for this is because a user's finger or other body part is inadvertently blocking a microphone. Another reason is that the phone is oriented in a sub-optimal position in relation to a user (e.g., the device is held so that the microphone faces away from a user's mouth). This can lead to difficulties in communication with others as well as with the information handling device. Therefore, it would be desirable if users were notified that the audio input was being adversely affected.

BRIEF SUMMARY

In summary, one aspect provides a method comprising: receiving, using a microphone of an electronic device, user audio input; detecting, using a processor, at least one factor that impacts quality of the audio input received; and notifying, using an output device of the electronic device, a user of an event associated with the at least one factor.

Another aspect provides an electronic device, comprising: an output device; a microphone; a processor operatively coupled to the microphone and the output device; a memory device that stores instructions executable by the processor to: receive, using the microphone, user audio input; detect at least one factor that impacts quality of the audio input received; and notify, using the output device, a user of an event associated with the at least one factor.

A further aspect provides a product, comprising: a storage device that stores code executable by a processor, the code comprising: code that receives user audio input using a microphone; code that detects at least one factor that impacts quality of the audio input received; and code that notifies a user of an event associated with the at least one factor.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
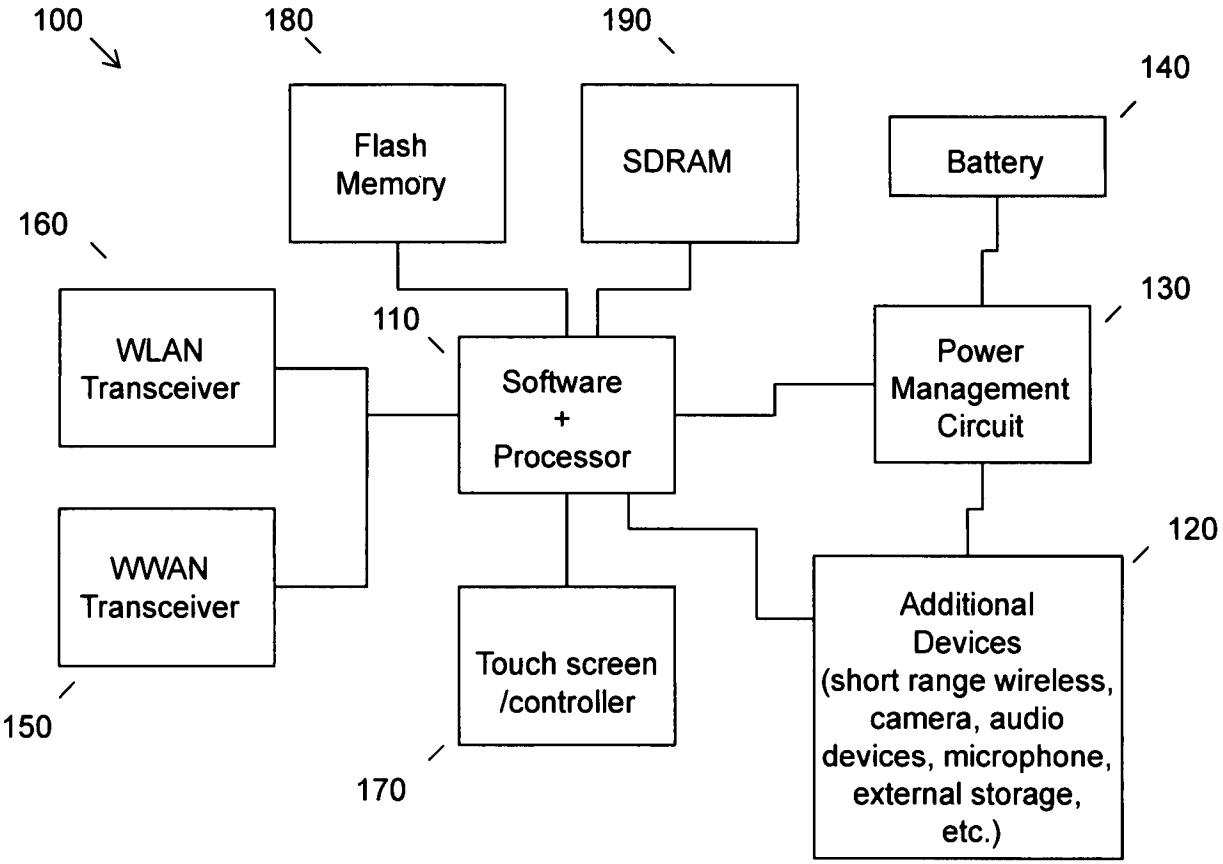
FIG. 1 illustrates an example of information handling device circuitry.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

An aspect of portable information handling devices ("devices") is that they provide users the ability to communicate. Users can communicate with other users and they can also communicate with the device itself, e.g., directing it to perform specific tasks. For example, a virtual personal assistant can be directed to look up directions to a particular restaurant. Depending on the situation, some methods of communication are more desirable than others.

One current method to assist in communication involves audible input by a user into a microphone located on the device. Audible input allows users increased flexibility when communicating because they do not need to look at their device to communicate. Users can also verbally direct their device to perform specific tasks. In some instances, users do not even need to be holding their device to transmit audible input. For example, when driving, a speaker phone mode may be activated on the device, allowing a user to enter audible input from many feet away. However, due to the different ways users hold or position their devices, the quality of the input audio may be diminished. For example, users may hold the device in such a way that a body part, such as a finger, blocks the microphone port. In another example, users may hold the device at an orientation where the microphone port points away from a user's mouth. In these instances, the diminished quality of the audio input may make it difficult for communication partners to understand what the user is saying. Additionally, the reduction in audio input quality may also prevent a device from successfully carrying out a communicated task.

These technical issues present problems for users in that inputting sub-optimal audio input into a device may cause errors. A conventional solution to assist in optimizing audio quality is to receive feedback from a conversation partner, or a device, that the audio quality is poor. However, this solution does not identify why the quality of the audio input was diminished or how a user can improve it, leading to wasted time by the user as he or she tries to figure out how to fix the problem.

Accordingly, an embodiment provides a method for improving audio input quality to an electronic device (e.g., smart phones, tablets, etc.). Using this method, an embodiment may detect an audio quality input factor that impacts the quality of the audio input received and may then notify a user of the existence of such an audio quality input factor. One embodiment may utilize haptic feedback to notify a user of the presence of an audio quality input factor. For example, when participating in telephone conversations, some users may hold the phone in such a way that a finger blocks the microphone port on the phone. A device may detect the blockage and may subsequently vibrate in order to notify the user that the microphone port is being blocked.

In an embodiment, a device may detect that the quality of the audio input received is impacted based upon a comparison to prior recorded audio data. The audio levels from past usage instances may be recorded to establish a baseline audio quality. For example, if the audio quality of the received audio input is only fifty percent the quality of the baseline value, then the device may notify a user that the volume is being impacted.

The illustrated example embodiments will be best understood by reference to the figures. The following description is intended only by way of example, and simply illustrates certain example embodiments.

While various other circuits, circuitry or components may be utilized in information handling devices, with regard to smart phone and/or tablet circuitry 100, an example illustrated in FIG. 1 includes a system on a chip design found for example in tablet or other mobile computing platforms. Software and processor(s) are combined in a single chip 110. Processors comprise internal arithmetic units, registers, cache memory, busses, I/O ports, etc., as is well known in the art. Internal busses and the like depend on different vendors, but essentially all the peripheral devices (120) may attach to a single chip 110. The circuitry 100 combines the processor, memory control, and I/O controller hub all into a single chip 110. Also, systems 100 of this type do not typically use SATA or PCI or LPC. Common interfaces, for example, include SDIO and I2C.

There are power management chip(s) 130, e.g., a battery management unit, BMU, which manage power as supplied, for example, via a rechargeable battery 140, which may be recharged by a connection to a power source (not shown). In at least one design, a single chip, such as 110, is used to supply BIOS like functionality and DRAM memory.

System 100 typically includes one or more of a WWAN transceiver 150 and a WLAN transceiver 160 for connecting to various networks, such as telecommunications networks and wireless Internet devices, e.g., access points. Additionally, devices 120 are commonly included, e.g., a microphone that receives audio input of a user and converts the audio input into digital input. System 100 often includes a touch screen or touch surface 170 for data input and display/rendering. System 100 also typically includes various memory devices, for example flash memory 180 and SDRAM 190.

Figure 2:
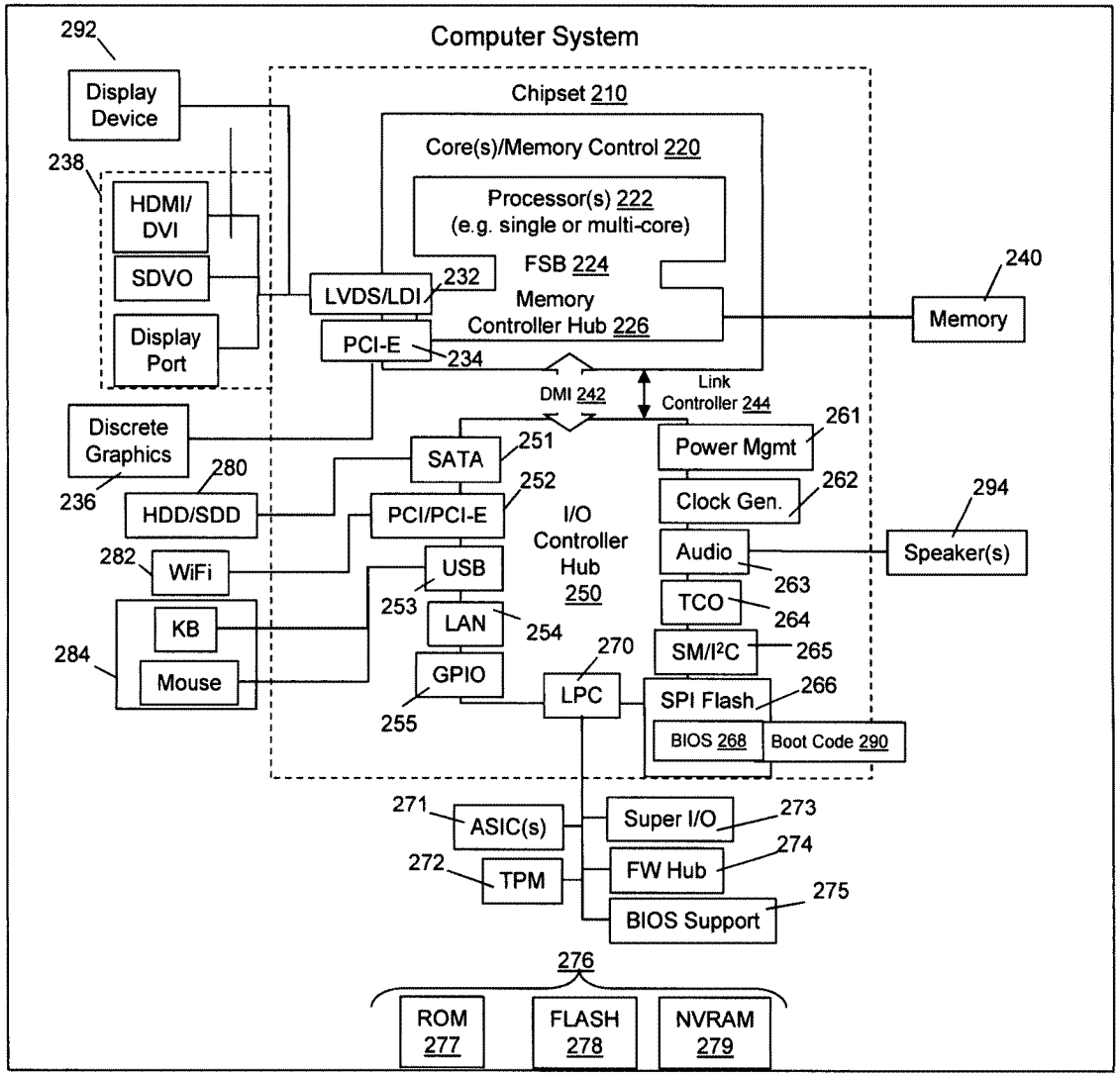
FIG. 2 illustrates another example of information handling device circuitry.

FIG. 2 depicts a block diagram of another example of information handling device circuits, circuitry or components. The example depicted in FIG. 2 may correspond to computing systems such as the THINKPAD series of personal computers sold by Lenovo (US) Inc. of Morrisville, N.C., or other devices. As is apparent from the description herein, embodiments may include other features or only some of the features of the example illustrated in FIG. 2.

The example of FIG. 2 includes a so-called chipset 210 (a group of integrated circuits, or chips, that work together, chipsets) with an architecture that may vary depending on manufacturer (for example, INTEL, AMD, ARM, etc.). INTEL is a registered trademark of Intel Corporation in the United States and other countries. AMD is a registered trademark of Advanced Micro Devices, Inc. in the United States and other countries. ARM is an unregistered trademark of ARM Holdings plc in the United States and other countries. The architecture of the chipset 210 includes a core and memory control group 220 and an I/O controller hub 250 that exchanges information (for example, data, signals, commands, etc.) via a direct management interface (DMI) 242 or a link controller 244. In FIG. 2, the DMI 242 is a chip-to-chip interface (sometimes referred to as being a link between a "northbridge" and a "southbridge"). The core and memory control group 220 include one or more processors 222 (for example, single or multi-core) and a memory controller hub 226 that exchange information via a front side bus (FSB) 224; noting that components of the group 220 may be integrated in a chip that supplants the conventional "northbridge" style architecture. One or more processors 222 comprise internal arithmetic units, registers, cache memory, busses, I/O ports, etc., as is well known in the art.

In FIG. 2, the memory controller hub 226 interfaces with memory 240 (for example, to provide support for a type of RAM that may be referred to as "system memory" or "memory"). The memory controller hub 226 further includes a low voltage differential signaling (LVDS) interface 232 for a display device 292 (for example, a CRT, a flat panel, touch screen, etc.). A block 238 includes some technologies that may be supported via the LVDS interface 232 (for example, serial digital video, HDMI/DVI, display port). The memory controller hub 226 also includes a PCI-express interface (PCI-E) 234 that may support discrete graphics 236.

In FIG. 2, the I/O hub controller 250 includes a SATA interface 251 (for example, for HDDs, SDDs, etc., 280), a PCI-E interface 252 (for example, for wireless connections 282), a USB interface 253 (for example, for devices 284 such as a digitizer, keyboard, mice, cameras, phones, microphones, storage, other connected devices, etc.), a network interface 254 (for example, LAN), a GPIO interface 255, a LPC interface 270 (for ASICs 271, a TPM 272, a super I/O 273, a firmware hub 274, BIOS support 275 as well as various types of memory 276 such as ROM 277, Flash 278, and NVRAM 279), a power management interface 261, a clock generator interface 262, an audio interface 263 (for example, for speakers 294), a TCO interface 264, a system management bus interface 265, and SPI Flash 266, which can include BIOS 268 and boot code 290. The I/O hub controller 250 may include gigabit Ethernet support.

The system, upon power on, may be configured to execute boot code 290 for the BIOS 268, as stored within the SPI Flash 266, and thereafter processes data under the control of one or more operating systems and application software (for example, stored in system memory 240). An operating system may be stored in any of a variety of locations and accessed, for example, according to instructions of the BIOS 268. As described herein, a device may include fewer or more features than shown in the system of FIG. 2.

Information handling device circuitry, as for example outlined in FIG. 1 or FIG. 2, may be used in devices such as tablets, smart phones, personal computer devices generally, and/or other mobile electronic devices which users may use to stream content. For example, the circuitry outlined in FIG. 1 may be implemented in a tablet or smart phone embodiment, whereas the circuitry outlined in FIG. 2 may be implemented in a personal computer embodiment, e.g., a laptop personal computer.

Figure 3:
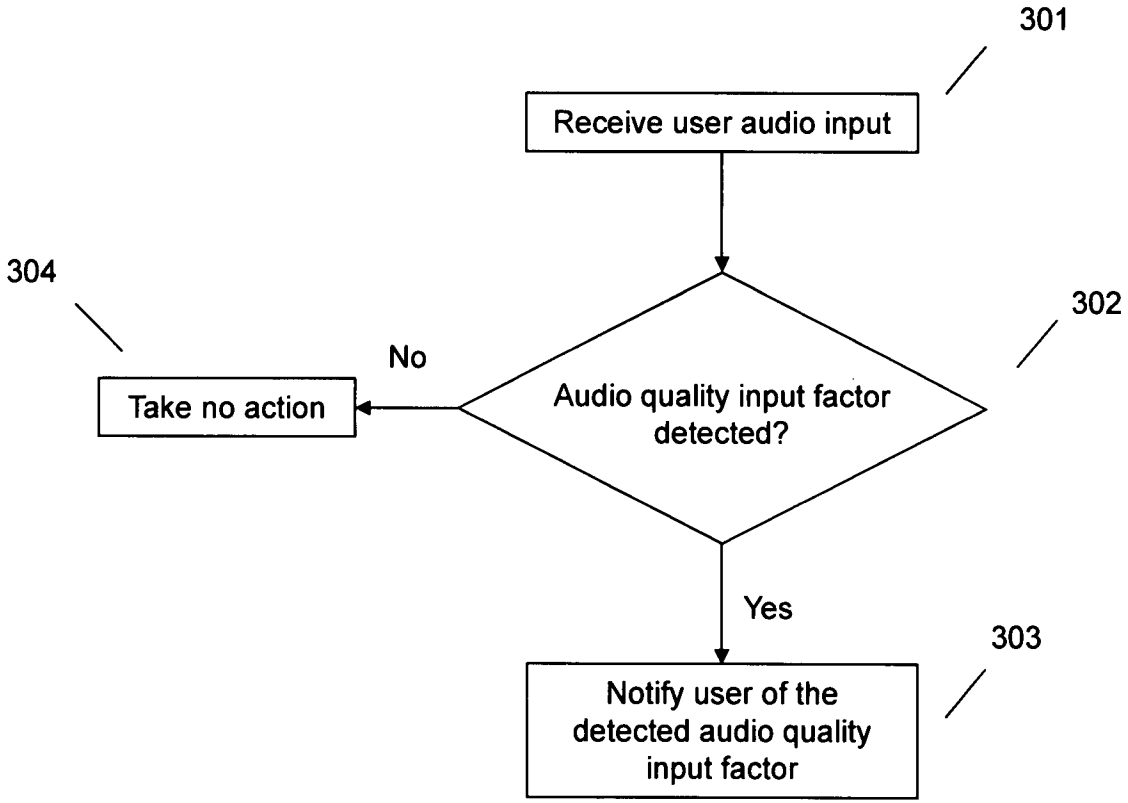
FIG. 3 illustrates an example method of notifying a user to improve voice quality.

Referring now to FIG. 3, at 301, an embodiment may receive audio input from a user. Audio input may be received at a microphone located on a device. The position and number of microphones on a device may differ based on varying device models and configurations. Audio input may be received from a distance, e.g., through the utilization of a speaker phone mode on a device. In this mode, a user may input audio to a device from many feet away, oftentimes without holding the device.

At 302, an embodiment may detect the presence of at least one audio quality input factor. An audio quality input factor is any factor that impacts the quality of audio input transmitted to a device. An audio quality input factor may include, but is not limited to, a physical blockage of a microphone (e.g., by a user's finger), a predetermined orientation of the electronic device (e.g., a device that is being held so that the microphone faces away from a user's mouth), and a predetermined distance between the user and the electronic device (e.g., a device is too far away from a user to receive good quality audio input). If no audio quality input factor is detected, then a device takes no additional action, as indicated at 304.

An embodiment may detect an audio quality input factor by utilizing data attained from a proximity sensor located on a device. A proximity sensor is a sensor that is able to detect the presence of nearby objects. It may emit an electromagnetic field, or beam, and monitors for changes in the field or return signal. Alternatively, a passive type proximity sensor may be utilized, for example a piezoelectric sensor. Moreover, other types of sensors may be utilized to detect proximity, e.g., a camera that captures images of the user to detect the user's position in relation to the device. Two or more sensors may be used in combination. Two or more sensor types may be used in combination.

In an embodiment, a proximity sensor is located adjacent to a microphone. Therefore, if an object trips the sensor, then there is a high probability that the object is blocking or interfering with the microphone input port or hole as well.

In an embodiment, a device orientation sensor may be utilized to detect that a device is being held at an improper orientation. Device orientation sensors may include, but are not limited to, gyroscopes and compass sensors. In an embodiment, the sensors may detect that a user is holding the device in a way that is not conducive to good audio input quality. The device orientation sensors may identify the position of the device in three-dimensional space based on the spatial x, y, and z coordinates of the device. In an embodiment, optimal positions for a device engaged in audio input reception functions may be predefined as a range of acceptable x, y, and z coordinates. If a device is oriented to a particular position in which the spatial coordinates of the device fall outside the predefined optimal range, then a device may notify the user. For example, based on the information from the device orientation sensors, an embodiment may detect that a device is being held in such a way that the microphone points away from the user's mouth. Three-dimensional positional information regarding optimal device orientation may be programmed onto the device or may be accessed from information located on the cloud.

In an embodiment, data obtained from a microphone may be used to detect the presence of an audio quality input factor. In an embodiment, a baseline audio input quality value may be established. The baseline audio input quality value may be the volume of the received audio input and signify an acceptable volume level. In an embodiment, an audio quality input factor may be detected by comparing the baseline audio input quality value to a current audio input value. If the current audio input value is less than the baseline audio input quality value, an audio quality input factor may be present.

In an embodiment, the baseline audio input quality value may be chosen by a user from a range of predefined baseline audio input quality values. In an embodiment, the baseline audio input quality value may be established through a dedicated training phase in which a user transmits audio input into the device at least once, e.g., when prompted, to establish the baseline value. In another embodiment, the baseline audio input quality value may be gradually established as an average of a number of compiled audio input values collected over a set period of time.

At 303, an embodiment may notify a user that an audio quality input factor has been detected. In an embodiment, the notification may be achieved through haptic feedback. Types of haptic feedback that may be employed include, but are not limited to, buzzing, ringing, verbal feedback, visual textual feedback, and visual animation feedback. An embodiment may notify a user through haptic feedback that there is a physical blockage of the microphone. In an embodiment, a haptic device (e.g., an actuator device) may be located near the microphone to give a user a more natural indication they are blocking the microphone. For example, if a user's finger is covering the microphone during audio input, then the haptic device may buzz, notifying a user that the finger is covering or proximate to the microphone port. In an embodiment, haptic feedback may be used to intuitively guide a user to adjust the holding orientation of a device. For example, if a device is positioned in a sub-optimal alignment, the device may buzz aggressively initially. As a user changes their holding orientation of a device to an approved holding orientation, the buzzing decreases. Moreover, an embodiment may provide increasing or decreasing haptic feedback as the audio quality input factor changes, e.g., as the user moves his or her finger closer to or further from the microphone port.

Textual instructions on a display screen may identify the audio quality issue, e.g., with the current holding orientation, and instruct a user to adjust to a proper holding orientation. For example, if a user is holding a device where the microphone port is angled away from the audio source (e.g., the user mouth or face), textual notification may be displayed on the screen. Additionally, other sensors such as a camera, may be used to detect the location or presence of the user in relation to the device.

Furthermore, an embodiment may provide an animation or graphic presentation to the user regarding the audio quality input factor that is detected. By way of non-limiting example, if the user is holding the device at an angle that is predetermined to be associated with poor audio reception, an embodiment may provide a textual notification along with an animated cue to reorient the phone. This may take place in real time or near real time, e.g., as the user operates the device, such as during a voice call. Similarly, an embodiment may user the actual received audio (e.g., volume level thereof) to detect the audio quality input factor.

The mode in which a device is used may be taken into account in detecting an audio quality input factor and/or in selecting a notification type. For example, a phone that is being used in speaker mode may trigger a check for spatial orientation coordinates or other sensor inputs (e.g., accelerometer inputs), as users will often place a phone in speaker mode on a surface such as a table or car mount while in use.

This may impact the quality of the received audio. For example, a user may place the phone on a table in speaker mode, but with the microphone port facing down. In such a circumstance, an embodiment may detect that the phone's orientation is opposite of the correct orientation for the highest quality audio reception. Additionally, the device's display screen may be oriented downward. Accordingly, an embodiment may select to provide a notification regarding the audio quality input factor and additionally may select to provide the notification via an output device other than the display screen, e.g., haptic feedback, audible feedback, etc.

As described herein, the audio quality input factor may be a factor associated with low quality audio input. Such factor may be predetermined or determined dynamically, or a combination of the foregoing. By way of example, certain device orientations or use modes may be associated with low quality audio reception. In contrast, certain real time (or near real time) detections, e.g., the actual received audio volume, may be utilized to detect an audio quality input factor.

An audio quality input factor may be a positive audio quality input factor or a negative audio quality input factor. For example, an embodiment may detect that low quality audio input is being received and provide a notification to the user that includes an instruction indicating how to improve the audio. Similarly, an embodiment may detect that the user has corrected the situation, and provide positive feedback regarding the improved audio input reception.

The various embodiments described herein thus represent a technical improvement to conventional audio quality optimizing techniques. Using the techniques described herein, an embodiment provides for detection of audio quality input factors that may affect audio quality during audio input by a user. Additionally, rather than having a user's conversation partner notify the user that the audio quality is poor, an embodiment dynamically notifies a user that an audio quality input factor has been detected, prompting the user to adjust the holding orientation of their device to a position that provides for better audio input quality.

As will be appreciated by one skilled in the art, various aspects may be embodied as a system, method or device program product. Accordingly, aspects may take the form of an entirely hardware embodiment or an embodiment including software that may all generally be referred to herein as a "circuit," "module" or "system." Furthermore, aspects may take the form of a device program product embodied in one or more device readable medium(s) having device readable program code embodied therewith.

It should be noted that the various functions described herein may be implemented using instructions stored on a device readable storage medium such as a non-signal storage device that are executed by a processor. A storage device may be, for example, an electronic, magnetic, electromagnetic, or semiconductor system, apparatus, or device, or any suitable combination of the foregoing. More specific examples of a storage medium would include the following: a portable computer diskette, a hard disk, a random access memory (RAM), a read-only memory (ROM), an erasable programmable read-only memory (EPROM or Flash memory), a portable compact disc read-only memory (CD-ROM), a magnetic storage device, or any suitable combination of the foregoing. In the context of this document, a storage device is not a signal and "non-transitory" includes all media except signal media.

Program code embodied on a storage medium may be transmitted using any appropriate medium, including but not limited to wireless, wireline, optical fiber cable, RF, et cetera, or any suitable combination of the foregoing.

Program code for carrying out operations may be written in any combination of one or more programming languages. The program code may execute entirely on a single device, partly on a single device, as a stand-alone software package, partly on single device and partly on another device, or entirely on the other device. In some cases, the devices may be connected through any type of connection or network, including a local area network (LAN) or a wide area network (WAN), or the connection may be made through other devices (for example, through the Internet using an Internet Service Provider), through wireless connections, e.g., near-field communication, or through a hard wire connection, such as over a USB connection.

Example embodiments are described herein with reference to the figures, which illustrate example methods, devices and program products according to various example embodiments. It will be understood that the actions and functionality may be implemented at least in part by program instructions. These program instructions may be provided to a processor of a device, a special purpose information handling device, or other programmable data processing device to produce a machine, such that the instructions, which execute via a processor of the device implement the functions/acts specified.

It is worth noting that while specific blocks are used in the figures, and a particular ordering of blocks has been illustrated, these are non-limiting examples. In certain contexts, two or more blocks may be combined, a block may be split into two or more blocks, or certain blocks may be re-ordered or re-organized as appropriate, as the explicit illustrated examples are used only for descriptive purposes and are not to be construed as limiting.

As used herein, the singular "a" and "an" may be construed as including the plural "one or more" unless clearly indicated otherwise.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

The invention claimed is:

1. A method, comprising:

receiving, at a microphone of an electronic device, audio input from a user;

detecting, using a processor, at least one factor that negatively impacts quality of the audio input received at the microphone; and notifying, using at least one output device of the electronic device, the user how to improve the quality of a subsequent audio input, wherein the at least one output device is a haptic device located substantially next to the microphone;

wherein the notifying comprises emitting a vibration from the haptic device responsive to detecting the at least one factor and thereafter decreasing a magnitude of the vibration responsive to detecting that the at least one factor is minimized.

2. The method of claim 1, wherein the detecting comprises detecting data selected from the group consisting of: data from a proximity sensor, data from the microphone, and data from a device orientation sensor.

3. The method of claim 2, wherein the proximity sensor is located adjacent to the microphone.

4. The method of claim 1, wherein the at least one factor is selected from the group consisting of: data from a predetermined proximity sensor, a physical block of the microphone, a predetermined orientation of the electronic device, and a predetermined distance between the user and the electronic device.

5. The method of claim 1, wherein the notifying comprises instructing the user to adjust a holding orientation of the electronic device.

6. The method of claim 1, further comprising establishing a baseline audio input value.

7. The method of claim 6, wherein the baseline audio input value is established through a dedicated training phase.

8. The method of claim 6, further comprising comparing the baseline audio input value to a current audio input value; and wherein the notifying comprises prompting the user when the current audio input value is less than the baseline audio input value.

9. An electronic device, comprising:

at least one output device;

a microphone;

a processor operatively coupled to the microphone and the output device;

a memory device that stores instructions executable by the processor to:

receive, at the microphone, audio input from a user;

detect at least one factor that negatively impacts quality of the audio input received at the microphone; and notify, using the at least one output device, the user how to improve the quality of a subsequent audio input, wherein the at least one output device is a haptic device located substantially next to the microphone;

wherein the notifying comprises emitting a vibration from the haptic device responsive to detecting the at least one factor and thereafter decreasing a magnitude of the vibration responsive to detecting that the at least one factor is minimized.

10. The electronic device of claim 9, further comprising a proximity sensor and a device orientation sensor;

wherein to detect comprises detecting data selected from the group consisting of: data from the proximity sensor, data from the microphone, and data from the device orientation sensor.

11. The electronic device of claim 10, wherein the proximity sensor is located adjacent to the microphone.

12. The electronic device of claim 9, wherein the at least one factor is selected from the group consisting of: data from a predetermined proximity sensor, a physical block of the microphone, a predetermined orientation of the electronic device, and a predetermined distance between the user and the electronic device.

13. The electronic device of claim 9, wherein to notify comprises instructing the user to adjust a holding orientation of the electronic device.

14. The electronic device of claim 9, wherein the instructions are further executable by the processor to establish a baseline audio input value.

15. The electronic device of claim 14, wherein the instructions are further executable by the processor to compare the baseline audio input value to a current audio input value; and wherein to notify comprises prompting the user when the current audio input value is less than the baseline audio input value.

16. A product, comprising:

a non-signal storage device that stores code executable by a processor, the code comprising:

code that receives audio input from a user at a microphone;

code that detects at least one factor that negatively impacts quality of the audio input received at the microphone; and code that notifies, using a haptic device located substantially next to the microphone, the user how to improve the quality of a subsequent audio input, wherein the notification comprises emitting a vibration from the haptic device responsive to detecting the at least one factor and thereafter decreasing a magnitude of the vibration responsive to detecting that the at least one factor is minimized.

* * * * *